United States Patent [19]

Zipperer

[11] 3,940,115

[45] Feb. 24, 1976

[54] EMULSIFYING AND DISPERSING APPARATUS

[76] Inventor: Manfred Zipperer, Etzenbach 141, 7813 Staufen; Br., Germany

[22] Filed: Apr. 1, 1974

[21] Appl. No.: 457,133

[30] Foreign Application Priority Data

Aug. 6, 1971 Germany ..... 2139497

[52] U.S. Cl. ..... 259/7; 259/95; 241/259.1; 241/261; 259/DIG. 30

[51] Int. Cl.[2] ..... B01F 7/16

[58] Field of Search ..... 259/95, 107, 96, DIG. 30, 259/7, 8, 5, 6, 21, 22, 23, 24, 41, 42, 43, 44; 241/259, 259.1, 261

[56] References Cited

UNITED STATES PATENTS

| | | | |
|---|---|---|---|
| 1,949,696 | 3/1934 | Schoneborn | 259/96 |
| 2,435,884 | 2/1948 | Galewski | 259/8 |
| 2,619,330 | 11/1952 | Willems | 259/96 |
| 2,965,362 | 12/1960 | Flottmann | 259/8 |
| 3,326,532 | 6/1967 | Lodge | 259/96 |

*Primary Examiner*—Robert W. Jenkins
*Attorney, Agent, or Firm*—Haseltine, Lake & Waters

[57] ABSTRACT

Emulsifying and dispersing apparatus for liquid-solids mixtures, comprising one or more cooperative and concentrically positioned stator and rotor rings having cutting rims with toothed portions for the passage of the mixtures being treated. Axial adjustment between stator and rotor is provided to permit changes in the spaces between the toothed portions so as to impart improved emulsifying and dispersing gradients to the materials.

8 Claims, 13 Drawing Figures

EMULSIFYING AND DISPERSING APPARATUS

FIELD OF THE INVENTION

The present invention relates to an emulsifying and dispersing apparatus and, more particularly, an apparatus having a working member formed of at least two relatively rotatable concentric cutting rims, preferably a rotor and a stator, and including a shearing portion providing an operative arrangement. The rims are disposed about a central material inlet or feed chamber shaped as a hollow housing, and portions of the rims rotate in opposed directions with a speed reaching high ultrasonic frequency values.

DISCUSSION OF THE PRIOR ART

It is known to utilize an emulsifying and dispersing apparatus for laboratories, research and production, which operate on the principle of employing a rotating working head located within the fluid mixture, generally fluid-solids mixtures. The rotating elements may be motor-driven propeller wheels, gears, material dispersing plates, tumbling plates, etc., which rotate at high peripheral speeds to provide the desired mixing effect.

Furthermore, apparatus are also known which provide for a rotor rotatable about a stator wherein, in a known embodiment, a slotted rotor tube rotates within a similarly slotted stator tube.

In accordance with the same principle, known mixing and dispersing devices operate in this technology, whereby both the rotor and the stator are provided with cooperatively acting shearing rings positioned about a centrally located material inlet chamber formed by a hollow housing.

In all of the above described prior-art embodiments, drawbacks are encountered in that is difficult or even completely impossible to attain the frequently required variation in the emulsion or dispersion gradient of the fluid mixture (emulsion) being mixed, or of the fluid-solids mixture (dispersion).

In effect, the above described apparatus can be driven slower or faster while employing only a single rotating operating head. As a result, the emulsion and dispersion gradient is changed only slightly, or essentially, the statistic distribution of the size of fluid and solid particles, contained in the liquid mixture, can be only minutely varied.

The foregoing also applies to devices operating with the stator-rotor principle in accordance with the prior-art constructions when attempting to change the emulsifying and dispersing gradient through variations in the speed of the rotors. In those apparatus there is a limited possibility of interchanging the rotor or rotors with other rotors having a larger or smaller number of slots formed therein, thereby permitting variations in the operating members distributed about the periphery thereof.

Needless to say, such changes are rather difficult to effect and require complex constructional expedients in the apparatus. It is also noted that the physical size of the emulsifying and dispersing device, such as the diameter and the height of the operating rings, exerts no influence on the emulsion and dispersion gradient, but only affects the capacity of the apparatus relative to the liquid quantities being mixed.

SUMMARY OF THE INVENTION

The present invention provides for an emulsifying and dispersing apparatus adapted to ameliorate or eliminate the drawbacks encountered in the prior art, wherein the emulsion and dispersing gradient may be readily varied, in a simple manner; this means in effect that the statistical distribution of the size of the fluid and solid particles is varied within the fluid being treated.

In order to provide a solution to the foregoing problems, the present invention provides for an apparatus in accordance with a completely different operating principle in which there are provided cooperative sidewalls of working members extending in concentric rotor and stator rings which are relatively rotatable, extend parallel to each other at an angle relative to the rotational axis, and wherein the rings are axially movable and adjustable relative to each other.

Investigations have determined that the emulsion and dispersion gradient is not dependent in the first instance on the number of operative teeth formed on the operating stator or rotor rings and on the relative rotation thereof, but is dependent on the effect between the peripheral velocity and the spacing distance between the operative ring portions of the stators and rotors. The inventive concept permits, in a simple manner, the variation of the spacing distance between the operating rings, in which it is not unduly significant if the stator and rotor are formed of only one or more operating rings.

The sidewalls of the operating member, which extends at an angle opposite to the other parallel sidewall and which slope opposite with respect to the rotation axis, define a change in the distance or spacing between the operating rings, responsive to a small axial displacement between the stator and the rotor. The overlap of the sidewalls between oppositely located working members thereby remains practically unchanged.

Upon any axial displacement between the rotor and the stator, but not against the sidewalls tilted in the axial direction, there is provided a change in the mutual overlap of the operating members, which results in a completely unequal emulsification and dispersion.

In a preferred constructional embodiment of the invention, there is provided a plurality of concentric operating stator and rotor rings which are rotatable relative to each other, which have sidewall members in the radially sequentially positioned operating rings, and defining walls tilted at acute angles relative to one or the other side of the rotational axis.

In a simplified embodiment according to this construction, the cooperative sidewalls extend in the radially sequentially positioned operating rings alternatively at an angle and in parallel to the rotational axis.

A particularly practical and preferred embodiment in accordance with the invention is provided wherein the extend of the deflection or slope angle of the parallel sidewalls of successive operating rings diminishes relative to the rotational axis in a radial direction, extending from the central inlet chamber toward the outermost operating ring.

Since the fluid mixture that is being mixed, in effect the fluid-solid material mixture, is always aspirated from the inner or central inlet chamber outwardly to between the operating rings, so as to be thereby adapted to be engaged between the teeth of the operating members, it is particularly advantageous to provide a device or an apparatus having a plurality of concentrically positioned operating stator and rotor rings, the distance between the operating portions of the rings diminishing from the radially innermost location (from the inlet chamber) outwardly from ring to ring.

This permits the misture which at first is only partially ground up to flow through the larger radially inwardly formed operating spaces without excessive restriction, to be partially reduced in size, so that it will not be unduly coarse for successive smaller spaces or distances between radially outer operating rings.

By axially displacing the operating rings relative to each other, a progressive basic adjustment of the operating steps may be obtained since, in view of the different slope angles of the sidewalls, the spacing distances between radially inner operating rings become relatively larger than those between radially outer operating rings.

In order to facilitate the axial adjustment of the operating rings relative to each other, in accordance with the invention, in which the operating rings radially alternate between stators and rotors, and wherein the rotor shaft for the apparatus is positioned in a hollow stator support conduit, there is provided an adjusting device which effects the relative axial displacement and adjustment between the operating rings, and consequently the spatial distance between the sidewalls thereof, thereby resulting in the axial adjustment of the rotor relative to the stator, or conversely the stator relative to the rotor.

According to important features of the invention, an emulsifying dispersing apparatus is provided which comprises a plurality of concentric cutting rims rotatable relative to each other, mounted in radial alternation on a stator and on a rotor, the latter being rotatable relative to the former, the rims including teeth which interact in a shearing relation, and defining therebetween a cavity which serves as a central feed chamber, and the teeth further interact at frequencie reaching up to supersonic values, wherein opposite cutting flanks of the teeth are rotatable relative to one another in parallel alternation, the flanks being inclined at an acute angle to the axis of rotation toward respective adjoining sides, when viewed from opposite directions, the rims being axially slidable and adjustable, and wherein the magnitude of the angle of parallel flanks of radially consecutive rims decreases to the axis of rotation, looking from the feed chamber toward an outer one of the rims.

BRIEF DESCRIPTION OF THE DRAWINGS

Exemplary embodiments and structures according to the invention, and particularly the further application thereof as a continuously operating flow apparatus, may be readily recognized in the present disclosure. Reference is now being had to the specification that follows, in conjunction with the accompanying drawings, wherein.

DETAILED DESCRIPTION

Figure 1:
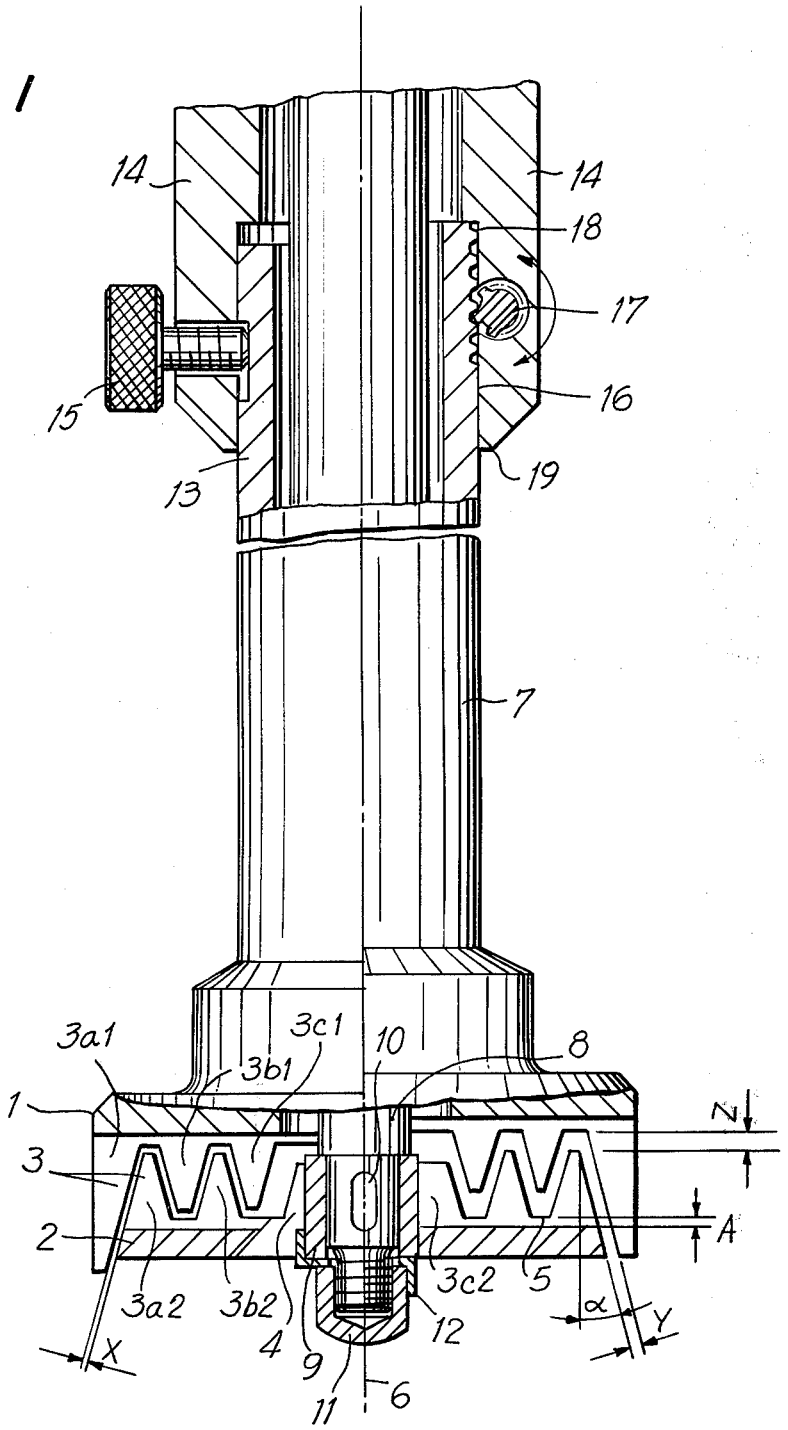
FIG. 1 is a partly sectional view of a first exemplary embodiment of the invention, in which the left-hand portion of the figure shows an adjustment for small operating gaps X, and the right-hand side for large gaps Y.

In accordance with the preferred embodiment shown in FIG. 1, the operative stage of the apparatus is formed of a stator 1 and a rotor 2, which include operating rings 3 provided with cutting rims. In the described embodiment, three operative toothed rings, **3*a*1, 3*b*1 and 3*c*1 operate on stator 1 in conjunction with three operating rings 3*a*2, 3*b*2 and 3*c*2 on rotor 2. The innermost toothed ring 3*c*2 of the rotor consists of only, for example, three teeth, referring to FIG. 3, so as to provide a cavity or hollow chamber 4** forming a central material or liquid inlet (feed) conduit.

Figure 3:
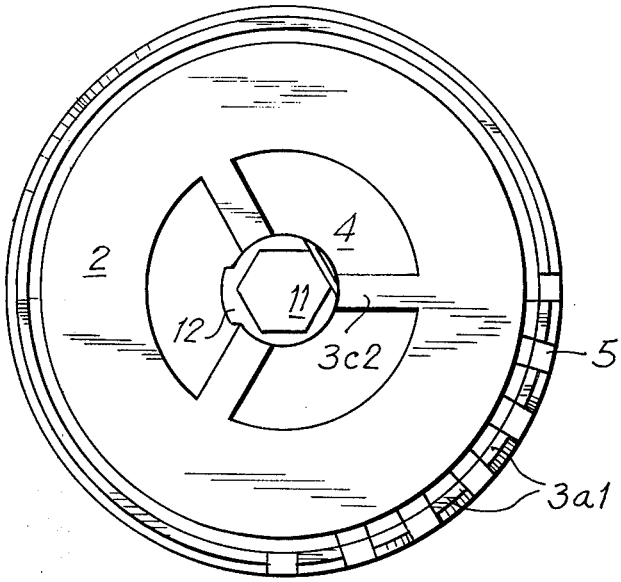
FIG. 3 is a bottom plan view of the embodiment of FIG. 2, in which a radially outermost operating ring is only illustrated for a segment of the circumference thereof.

The operative or working tool components of the operating rings consist of teeth which, as may be seen from FIG. 1, have pyramid-shaped cross-sections in the radial cross-sectional direction, and rectangular cross-sectional shapes in the peripheral cross-sectional direction, as shown in FIG. 3. In view of the provision of the teeth, the rings **3*a*1 . . . , 3*a*2 . . . can best be termed cutting rims, as was mentioned before. Between opposed sidewalls or cutting flanks of the teeth of radially adjacent operating rings, the flanks being inclined at an acute angle, there are provided predetermined spaces X and Y for the liquid dispersion gradient. Through axial adjustment of stator 1 relative to rotor 2**, or inversely, by a distance Z, the spacing distance may be predetermined without significantly changing the overlapping and the shearing cooperation between the operative portions of the rings.

In order to obtain a reasonably equal operating effect even with large distances Z, the roots 5' of the teeth between the teeth of radially consecutive operating rings on stator 1 and rotor 2, respectively, are a distance A (see FIGS. 1, 2) higher than the roots of the teeth between adjacent teeth of each ring, with the exception of the tooth root 5, according to FIG. 3, between the teeth of the outermost operating ring **3*a*1. The slope angle of the sidewalls of the teeth relative to the rotational axis 6 of rotor 2 is designated by $\alpha$. Further explanations in this respect will appear later, with reference to FIG. 13**.

It will be understood by those skilled in the art that the structure just described constitutes an emulsifying dispersing apparatus which has a plurality of the concentric cutting rims 3a1 . . . , 3a2 . . . , rotatable relative to each other, mounted in radial alternation on stator 1 and rotor 2, respectively, the latter being rotatable relative to the former, the rims including teeth which interact in a shearing relation, and defining therebetween a cavity which serves as the central feed chamber 4. The teeth interact at frequencies reaching up to supersonic values, the opposite cutting flanks of the teeth being rotatable relative to one another in parallel alternation, the flanks being inclined at an acute angle to the axis of rotation 6 toward respective adjoining sides, when viewed from opposite directions. the rims being axially slidable and adjustable. It will be understood that the magnitude of the angle of parallel flanks of radially consecutive rims decreases to the axis of rotation, looking from the feed chamber toward an outside one of the rims.

The stator 1 is fastened onto a stator support conduit 7. The rotor 2 is connected by means of suitable connectors and pins with a drive shaft 8 having a substantially lengthwise axis in the inventive apparatus. As can readily be seen from the drawings, the stator, rotor and the drive shaft have a common rotational axis. The connectors and pin components consist of a connecting housing 9 and a wedge 10 which may be fastened by means of a closed nut 11 on a threaded connector 12. The axial adjustment along the distance Z between rotor 2 and stator 1 results through rotation of stator tube 7 in a thread 13 of a connecting flange 14, for example, an attaching flange for a driving motor.

A locking screw 15 is utilized to provide for fastening the rings into a predetermined position (left-hand portion of FIG. 1), whereas the right-hand portion of FIG. 1 illustrates the position where stator conduit 7 is supported in flange 14 through a sliding member 16. Upon rotation of a gear 17 within a gear segment 18 in tube 7, there is displacement of the rings along the distance Z.

The fastening in this manner results through a clamping of the shaft by gear 17. The adjusted position may be readily determined by markings on conduit or tube 7 in correlation with the lower edge 19 of flange 14.

Figure 2:
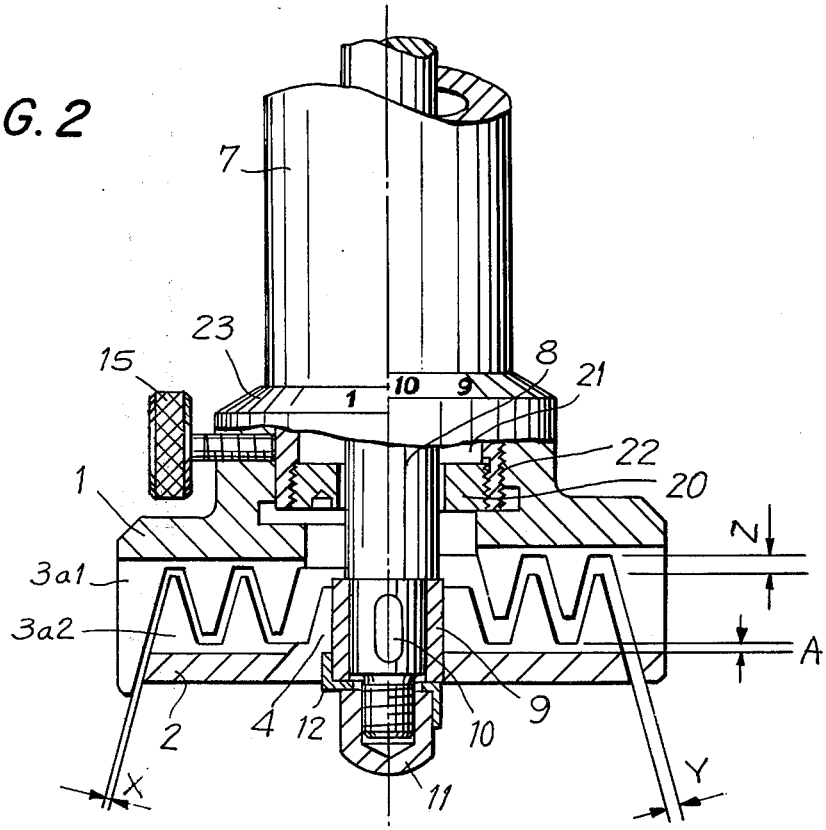
FIG. 2 is a partly sectional view of a further embodiment according to the invention, shown in a manner similar to that of FIG. 1.
Figure 4:
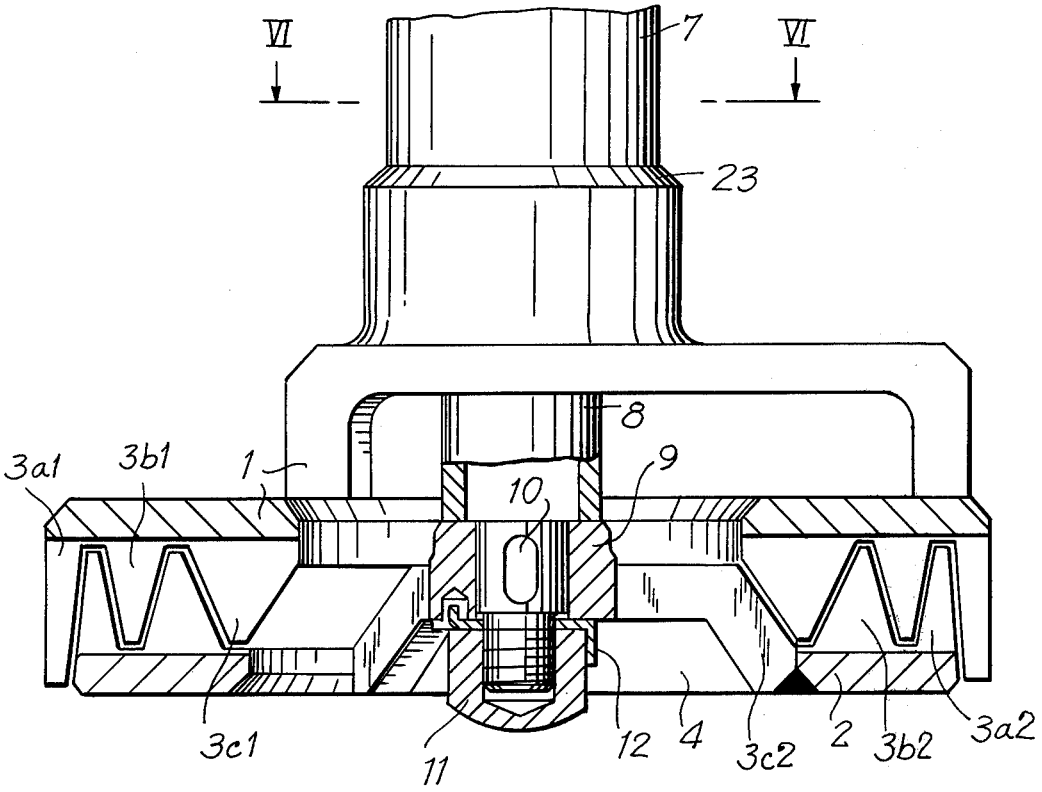
FIG. 4 is a partly sectional view of the operative portion of a further embodiment, showing differently tilted sidewalls of the operating rings.
Figure 5:
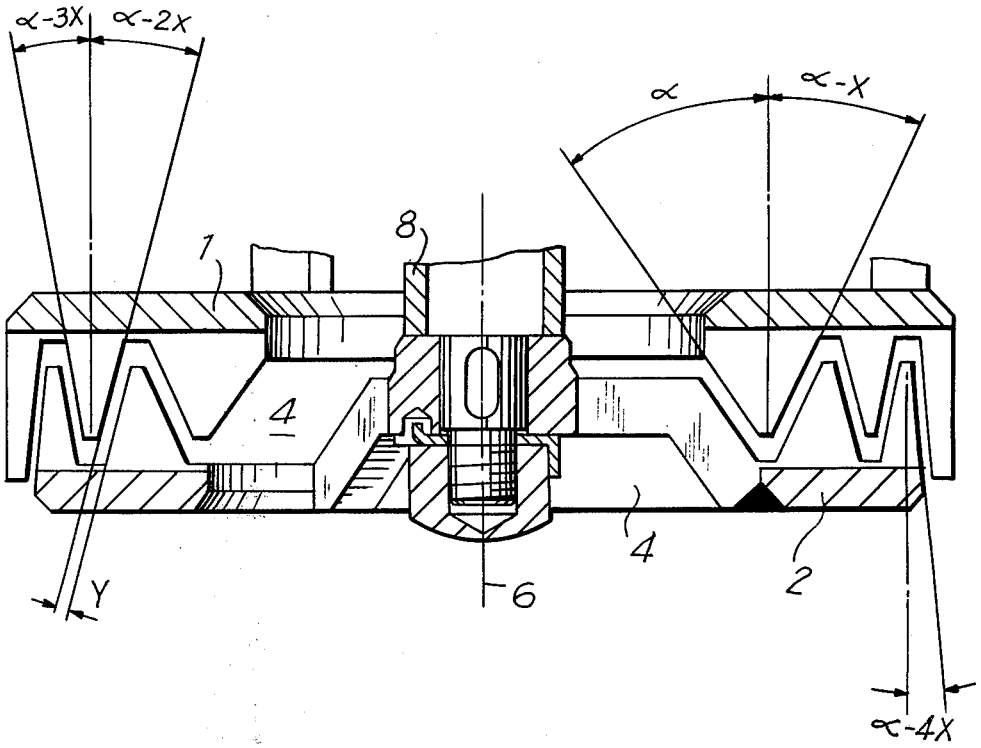
FIG. 5 is a view similar to that of FIG. 4, showing the operating elements with large gaps therebetween.
Figure 6:
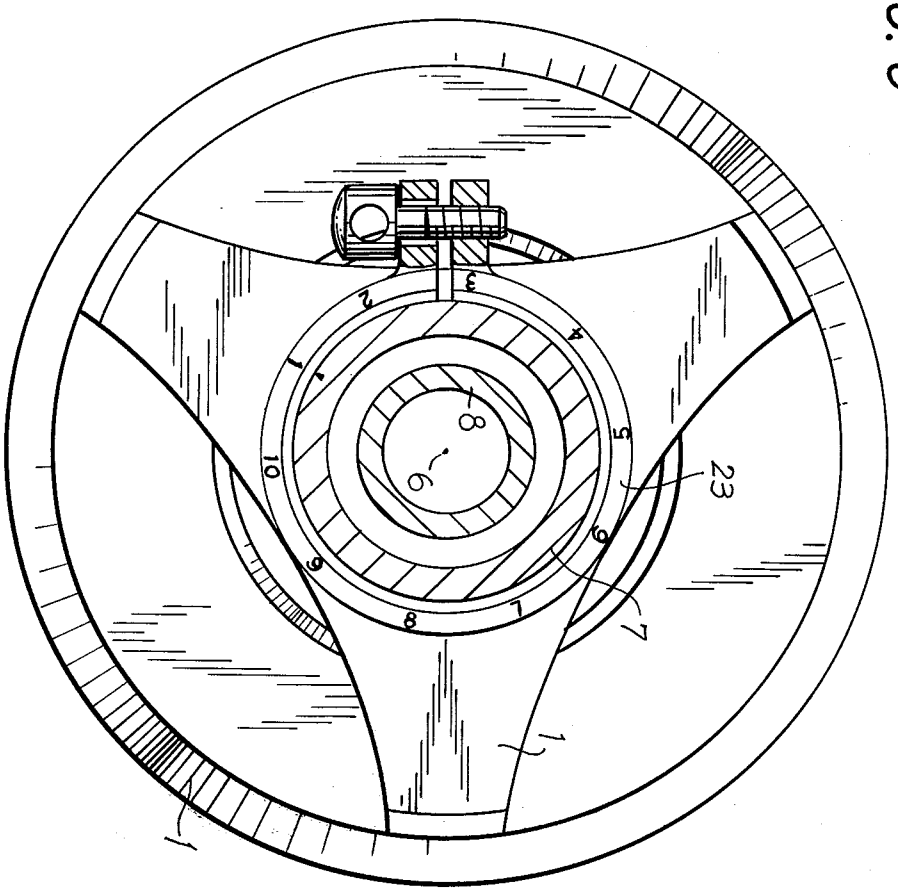
FIG. 6 is a downwardly directed, partly sectional view along line VI — VI in FIG. 4.
Figure 7:
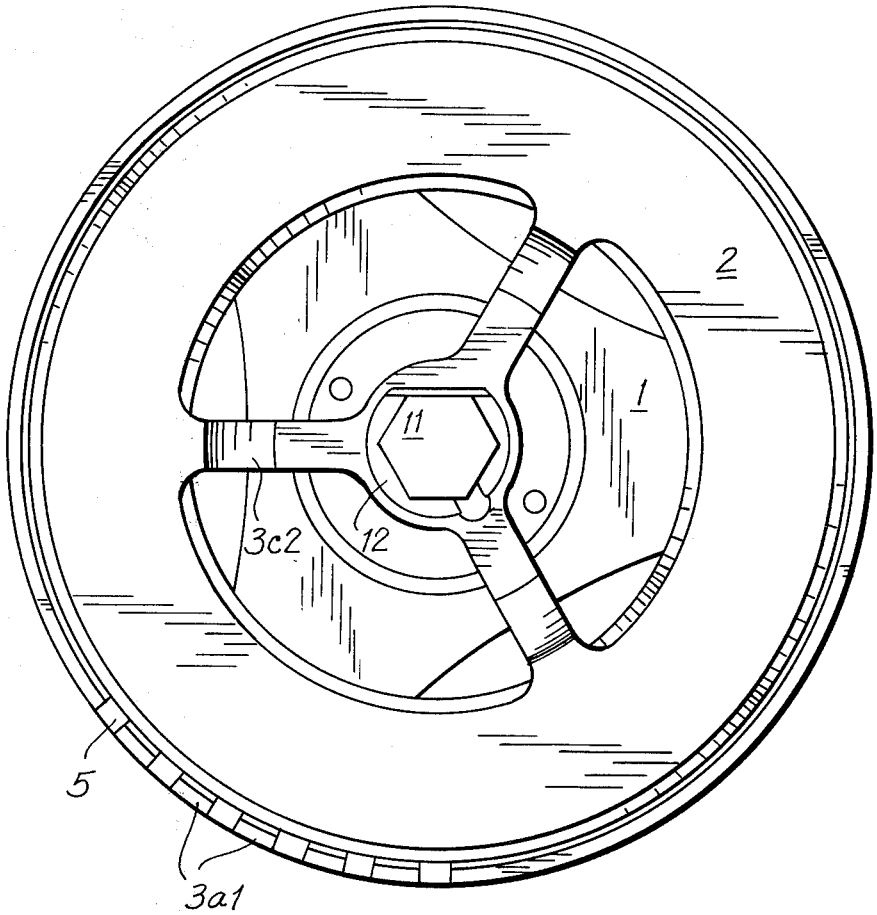
FIG. 7 is a bottom plan view of the embodiment of FIGS. 4 and 5.

In the embodiment according to FIG. 2, rotor shaft 8 is supported within a sleeve 20 in which, if desired, there may be provided a sealing element 21 above sleeve 20, for example, a sealing ring. The sleeve 20 may be provided internally with a "Teflon" coating. The axial adjustment between stator 1 and rotor 2 along distance Z is obtained in this embodiment by rotation of stator 1 on a portion 22 of support tube 7 thereof.

Locking into the resulting spaced position is again obtained through locking screw 15. The upper chamfered edge 23 of stator 1 is provided with markings which are adapted to cooperate with markings on tube 7 in accordance with a vernier scale, sometimes called a "Nonius calibration".

In the embodiments according to FIGS. 4 to 7 there is disclosed an operative stage with a progressive emulsifying effect. The slope angle $\alpha$ of the two sidewalls decreases in the direction extending from the rotational axis 6, in effect the central inlet chamber forming conduit 4, radially outwardly by the amount X. As a result, the space or distance Y decreases beginning between tooth rings 3c2 and 3c1 up to between rings 3a2 and 3a1. The adjusting device between stator 1 and rotor 2 may be constructed in accordance with any one of the previously described embodiments.

Figure 8:
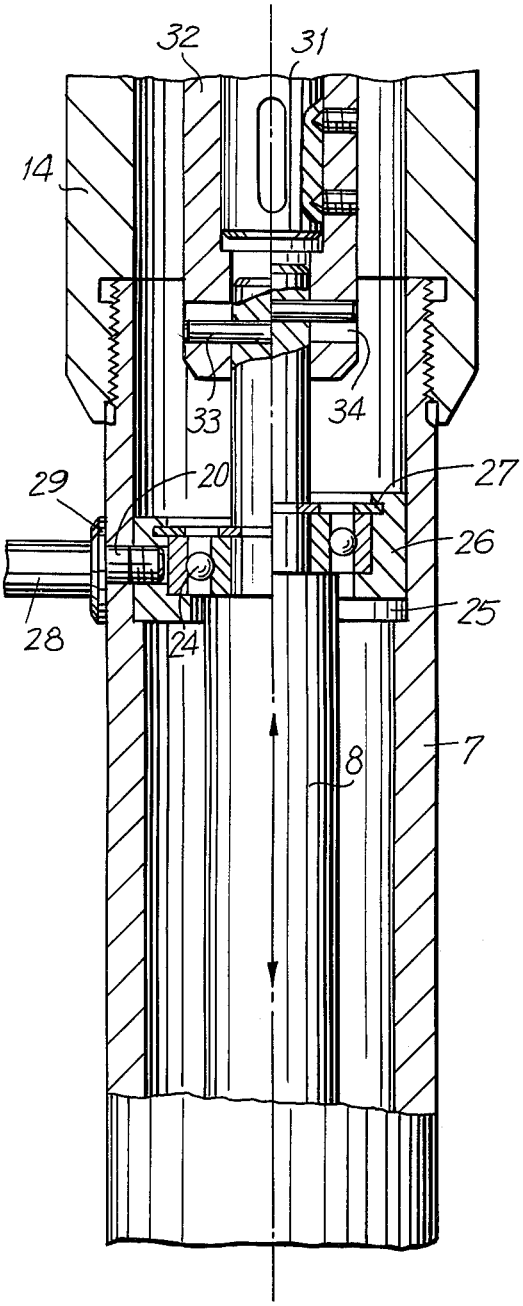
FIG. 8 is a longitudinal sectional veiw of an exemplary embodiment of an adjusting device according to the present invention.
Figure 9:
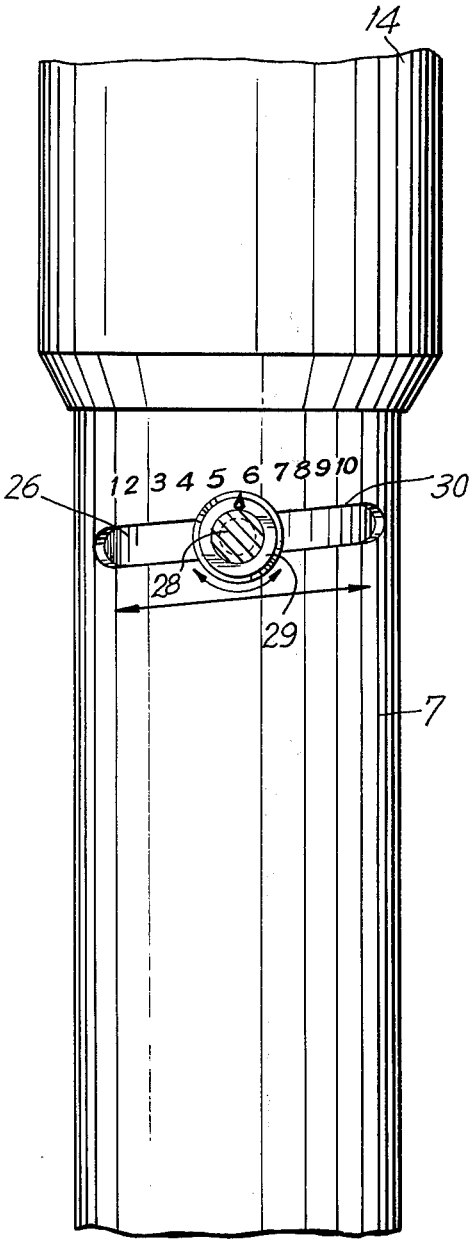
FIG. 9 is an elevational view of the device shown in FIG. 8.

In FIGS. 8 and 9 it may be ascertained that the constructions of stator 1 and rotor 2 are similar to those in FIGS. 1 through 7, in which, however, the adjusting device for the axial displacement along distance Z is so constructed, in conjunction with an upper bearing 24 for the drive shaft, such as rotor shaft 8, that an axial displacement of bearing 24, for a constant length of support tube 7 for stator 1, results in a change of the space or distance Y.

Within the upper end of stator tube 7 there is positioned a ring 26 located in a rotatable element 25 and supported within a sleeve, which supports the bearing 24. The axial position of the outer and inner rings of bearing 24 is fixed by means of so-called Seeger rings 27. The bearing ring 26 supports an arm 28 with a contact ring 29 which is rotatably positioned in bearing ring 26 within a threaded aperture.

The arm 28 extends through a diagonally extending slot 30 in support tube 7 of stator 1 and may be displaced within the slot so as to permit the ring 26 to create a lifting effect. Fastening of the components is obtained by rotation of arm 28 and consequent contact with ring 29. The rotation of shaft 8 is provided by a motor drive shaft 31 through a coupling 32 and a linkage rod 33 on shaft 8. A connecting coupling 32 is provided with an elongated milled aperture 34 which facilitates the lifting movement of line 33.

Figure 10:
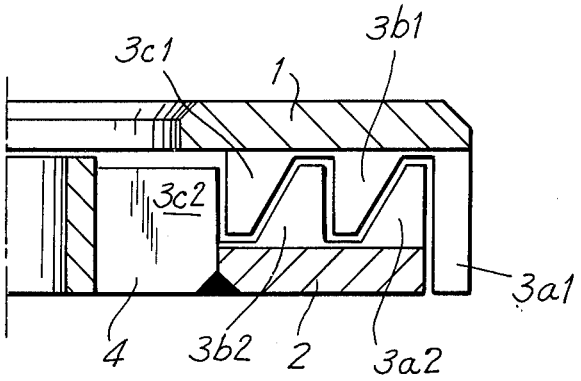
FIGS. 10 and 11 are sectional views of preferred embodiments of the operating rings.
Figure 11:
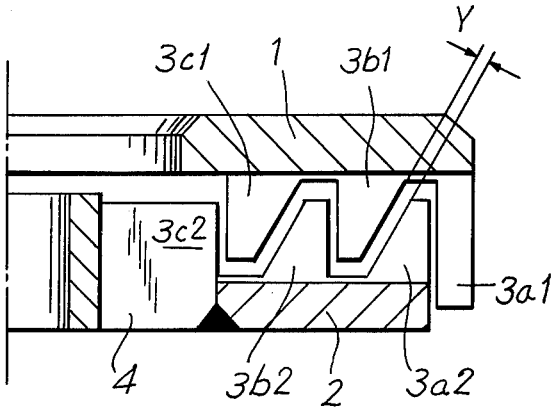

In the embodiments according to FIGS. 10 and 11 of the drawings, the cooperatively acting sidewall portions of radially sequential operating rings form teeth which alternate at an angle and in parallel relative to the rotational axis 6.

Figure 12:
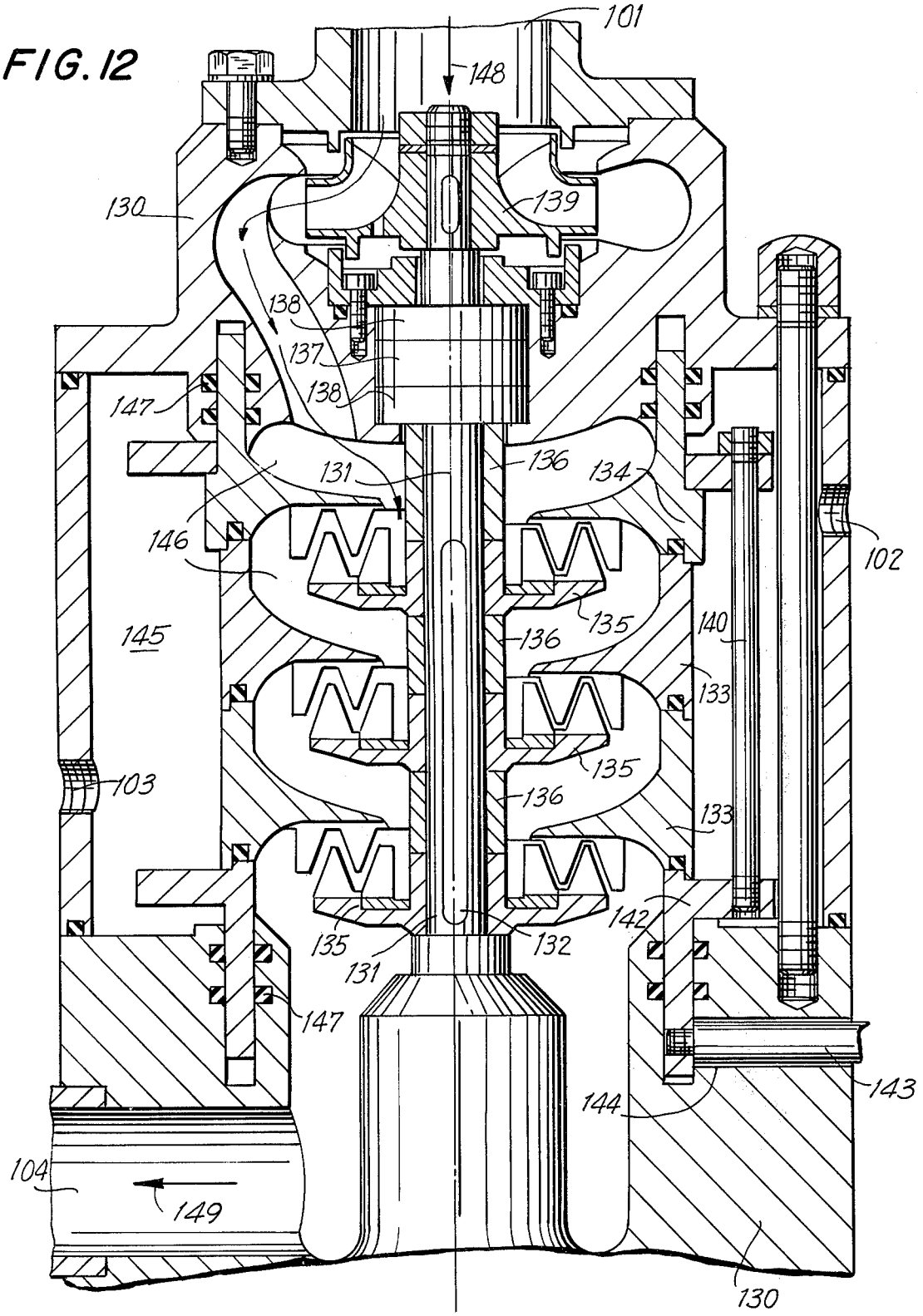
FIG. 12 is a partly sectional view of a continuous flow apparatus according to the present invention, having a plurality of operating stages.

Referring now to FIG. 12 of the drawings, there is illsutrated a somewhat schematically shown flow apparatus incorporating a plurality of operative stages in sequential order. A housing of this apparatus is designated 130, a drive shaft 131, an actuating wedge is 132, stators of second and third operative stages 133, a stator of a first operative stage 134, and rotors of all stages 135. The rotors 135 are fastened onto shaft 131 and located in their positions by means of distance or spacer rings 136.

The shaft 131 is supported by a bearing 137 at the end adjacent the drive, and bearing 137 is protected by means of two sleeve seals 138. A pump flywheel 139 is provided at an inlet 101 for the fluid being mixed, and is rigidly fastened onto shaft 131. Stators 133, 134 are rigidly threaded onto a support ring 142 by means of a threaded member 140 and a tension ring 141. Through rotation of a supporting member 143, which is located in a diagonally extending slot 144 in housing 130, there is provided axial displacement of the stator assembly, so as to result in the fastening of member 143, as well as its positioning and marking corresponding to the construction of arm 28 in FIGS. 8, 9.

An annular space 145 which encompasses the stator assembly may be utilized for the introduction of a cooling medium which may, for example, be introduced through an aperture 102 and removed through an aperture 103. The space 145, as well as operating spaces 146 of the operative stages may be sealed by means of suitable elements 147. The material being mixed is compacted by pump flywheel 139 at inlet 101 in the direction of an arrow 148, and is conveyed under pressure into the operating chamber of the first operative stage. The material then flows radially outwardly through the three stages and exits from the apparatus in the direction of an arrow 149 through an outlet aperture 104. By providing an accelerating pump in the form of flywheel 139, flow capacity is increased, particularly at small space relationships in the operating stages.

Figure 13:
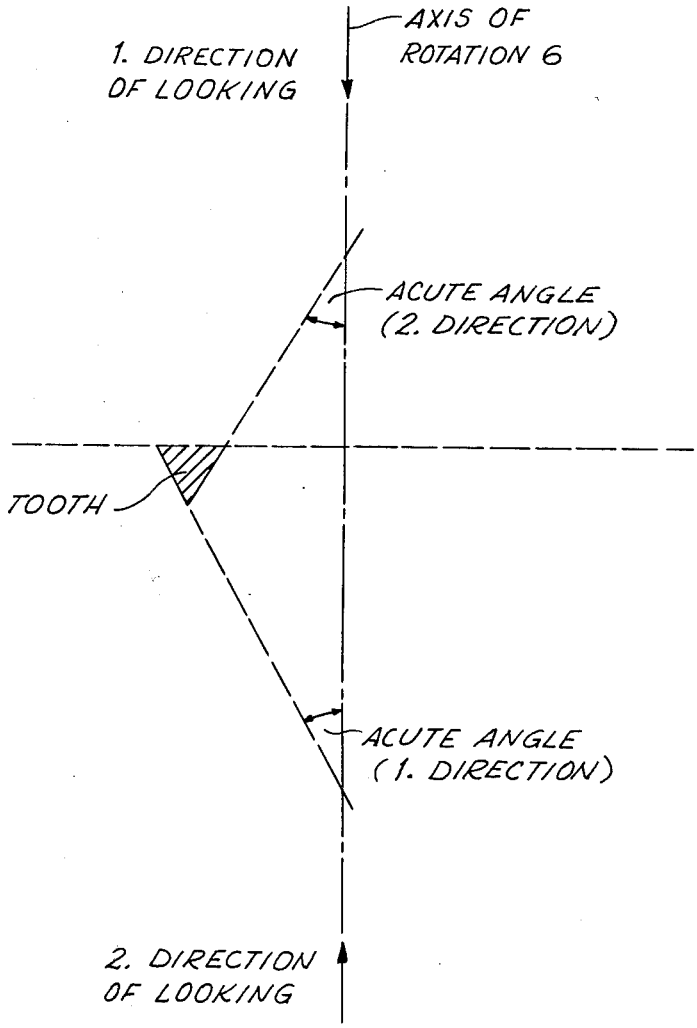
FIG. 13 is a schematic illustration of a single tooth in respect of the axis of rotation of the structure, with two successive viewing directions, to clarify "first" and "second" acute angles as they apply to the sides or flanks of the tooth.

In the schematic, explanatory illustration of FIG. 13 the axis of rotation 6 of the inventive apparatus is shown by a substantially vertical line, with two successive viewing directions ("direction of looking"), identified by numerals 1. and 2., and respective first and second acute angles (in the first and the second directions, respectively), as they apply to the sides of flanks of a tooth. This of course can be any tooth as shown in the detailed views of FIGS. 1, 2, . . . 12, as will be understood by those skilled in the art.

When viewing two adjoining sides of a tooth from the same direction, evidently one will be an acute and the other an obtuse angle; however they are both acute angles if viewed from opposite directions.

In addition to the aforedescribed embodiments, there may be provided further embodiments in which the rotors are collectively supported on a drive shaft and are adjustable with respect to oppositely positioned stationary stators.

While there has been shown what is considered to be the preferred embodiments of the invention, it will be obvious that modifications may be made which come within the spirit and scope of the disclosure of the specification.

What I claim is:

1. An emulsifying dispersing apparatus comprising: a plurality of concentric cutting rims rotatable relative to each other, mounted in radial alternation on a stator and on a rotor, having a common axis of rotation, said rotor being rotatable relative to said stator; said rims including interacting teeth and defining therebetweeen a cavity which serves as a central feed chamber, and said teeth further interacting at very high speeds; a hollow tubular mounting of said stator for a shaft of said rotor; wherein opposite cutting flanks of said teeth are rotatable relative to one another in parallel alternation, said flanks being inclined at an acute angle to the common axis of rotation toward respective adjoining sides, when viewed from opposite directions; adjusting means for the axial displacement and adjustment of respective rims toward one another on said stator and said rotor, and thus of a clearance gap between said cutting flanks, to facilitate relative axial adjustment between said rotor and said stator even during operation of the apparatus; wherein the magnitude of the angle of parallel flanks of radially consecutive ones of said rims decreases to the common axis of rotation, looking from said feed chamber toward an outside one of said rims; and wherein said teeth are pyramidal in the radial cross-sectional direction and rectangular in the peripheral cross-sectional direction; the tooth roots between teeth of said consecutive rims lying higher than the tooth roots between adjacent teeth of the same rim, with the exception of the tooth roots of an outermost one of said rims and finally wherein said tubular mounting includes a pair of telescopingly adjustable and interlocking tubular members forming said adjusting means, threaded means for axially adjusting said tubular members, and lockscrew means for interlocking said tubular members, and a vernier scale on one of said tubular members, being alignable with markings on another one of said tubular members for determining the relative position of said adjusting means.

2. The apparatus as defined in claim 1, wherein one of said tubular members includes a connecting flange for an external drive motor.

3. An emulsifying dispersing apparatus comprising: a plurality of concentric cutting rims rotatable relative to each other, mounted in radial alternation on a stator and on a rotor, having a common axis of rotation, said rotor being rotatable relative to said stator; said rims including interacting teeth and defining therebetween a cavity which serves as a central feed chamber, and said teeth further interacting at very high speeds; a hollow tubular mounting of said stator for a shaft of said rotor; wherein opposite cutting flanks of said teeth are rotatable relative to one another in parallel alternation, said flanks being inclined at an acute angle to the common axis of rotation toward respective adjoining sides, when viewed from opposite directions, adjusting means for the axial displacement and adjustment of respective rims toward one another on said stator and said rotor, and thus of a clearance gap between said cutting flanks, to facilitate relative axial adjustment between said rotor and said stator even during operation of the apparatus; wherein the magnitude of the angle of parallel flanks of radially consecutive ones of said rims decreases to the common axis of rotation, looking from said feed chamber toward an outside one of said rims; and wherein said teeth are pyramidal in the radial cross-sectional direction and rectangular in the peripheral cross-sectional direction; the tooth roots between teeth of said consecutive rims lying higher than the tooth roots between adjacent teeth of the same rim, with the exception of the tooth roots of an outermost one of said rims; further comprising threaded means for lengthwise adjustment of said tubular mounting with respect to said shaft, by rotating said stator with respect to a portion of said mounting, lockscrew means for locking said adjustment means relative to said mounting, and a vernier scale on said stator coordinated to markings on said tubular mounting.

4. An emulsifying dispersing apparatus comprising: a plurality of concentric cutting rims rotatable relative to each other, mounted in radial alternation on a stator and on a rotor, having a common axis of rotation, said rotor being rotatable relative to said stator; said rims including interacting teeth and defining therebetween a cavity which serves as a central feed chamber, and said teeth further interacting at very high speeds; a hollow tubular mounting of said stator for a shaft of said rotor; wherein opposite cutting flanks of said teeth are rotatable relative to one another in parallel alternation, said flanks being inclined at an acute angle to the common axis of rotation toward respective adjoining sides, when viewed from opposite directions, adjusting means for the axial displacement and adjustment of respective rims toward one another on said stator and said rotor, and thus of a clearance gap between said cutting flanks, to facilitate relative axial adjustment between said rotor and said stator even during operation of the apparatus; wherein the magnitude of the angle of parallel flanks of radially consecutive ones of said rims decreases to the common axis of rotation, looking from said feed chamber toward an outside one of said rims; and wherein said teeth are pyramidal in the radial cross-sectional direction and rectangular in the peripheral cross-sectional direction; the tooth roots between teeth of said consecutive rims lying higher than the tooth roots between adjacent teeth of the same rim, with the exception of the tooth roots of an outermost one of said rims; and finally wherein said rotor shaft includes two co-rotational and axially adjustable portions for the axial displacement of said rotor and said rims relative thereto relative to said tubular mounting, further comprising bearing means supporting said rotor shaft, an angled slot being formed in said tubular mounting, an arm extending through said slot for manually displacing said bearing means, and a vernier scale adjacent said slot for cooperation with at least one marking on said arm.

5. An emulsifying dispersing apparatus comprising: a plurality of concentric cutting rims rotatable relative to each other, mounted on radial alternation on a stator and on a rotor, having a common axis of rotation, said rotor being rotatable relative to said stator; said rims including interacting teeth and defining therebetween a cavity which serves as a central feed chamber, and said teeth further interacting at very high speeds; a hollow tubular mounting of said stator for a shaft of said rotor; wherein opposite cutting flanks of said teeth are rotatable relative to one another in parallel alternation, said flanks being inclined at an acute angle to the common axis of rotation toward respective adjoining sides, when viewed from opposite directions; adjusting means for the axial displacement and adjustment of respective rims toward one another on said stator and said rotor, and thus of a clearance gap between said cutting flanks, to facilitate relative axial adjustment between said rotor and said stator even during operation of the apparatus; wherein the magnitude of the angle of parallel flanks of radially consecutive ones of said rims decreases to the common axis of rotation, looking from said feed chamber toward an outside one of said rims; and wherein said teeth are pyramidal in the radial cross-sectional direction and rectangular in the peripheral cross-sectional direction; the tooth roots between teeth of said consecutive rims lying higher than the tooth roots between adjacent teeth of the same rim, with the exception of the tooth roots of an outermost one of said rims; further comprising hollow housing means which includes inlet and outlet apertures disposed in axially spaced-apart portions of said housing means, said apertures respectively communicating with said central feed chamber, and a plurality of consecutive stages, each including one of said stator and said rotor, whereby a continuous-flow apparatus is provided.

6. The apparatus as defined in claim 5, wherein said consecutive rims constitute respective ring means on said stator and on said rotor, and wherein said rotor and said ring means thereon are supported on said rotor shaft which is positioned within said housing means, said stator and said ring means thereon forming a stator assembly, said adjusting means being also effective for displacing said stator assembly relative to said housing means along the common axis of rotation.

7. The apparatus as defined in claim 5, wherein said consecutive rims constitute respective ring means on said stator and on said rotor, and wherein said stator and said ring means thereon are rigidly supported within said housing means, said rotor and said ring means thereon being supported on said rotor shaft which is within said housing means, said adjusting means being also effective for axially displacing said rotor and said ring means in addition to the displacement and adjustment of said respective rings.

8. The apparatus as defined in claim 5, further comprising an accelerating pump, preceding said rims and connected to said consecutive stages, for the mixing of materials.

* * * * *